US011214078B2

(12) United States Patent
Nordhus et al.

(10) Patent No.: US 11,214,078 B2
(45) Date of Patent: Jan. 4, 2022

(54) LABEL PRINTER AND CUTTER ASSEMBLY

(71) Applicant: Primera Technology, Inc., Plymouth, MN (US)

(72) Inventors: Brent L. Nordhus, Delano, MN (US); Darren W. Haas, Minnetonka, MN (US)

(73) Assignee: PRIMERA TECHNOLOGY, INC., Plymouth, MN (US)

( * ) Notice: Subject to any disclaimer, the term of this patent is extended or adjusted under 35 U.S.C. 154(b) by 0 days.

(21) Appl. No.: 16/881,389

(22) Filed: May 22, 2020

(65) Prior Publication Data

US 2021/0001645 A1 Jan. 7, 2021

Related U.S. Application Data

(60) Provisional application No. 62/870,402, filed on Jul. 3, 2019.

(51) Int. Cl.

| | |
|---|---|
| ***B41J 3/407*** | (2006.01) |
| ***B26D 1/30*** | (2006.01) |
| ***B41J 11/70*** | (2006.01) |
| ***B41J 15/04*** | (2006.01) |

(52) U.S. Cl.

CPC ..... *B41J 3/4075* (2013.01); *B26D 1/305* (2013.01); *B41J 11/70* (2013.01); *B41J 15/04* (2013.01)

(58) Field of Classification Search

CPC ..... B41J 3/4075; B41J 11/70; B41J 15/04; B26D 1/305

See application file for complete search history.

(56) References Cited

U.S. PATENT DOCUMENTS

| | | | | |
|---|---|---|---|---|
| 4,460,932 | A * | 7/1984 | Osanai ..... | G11B 5/5517 360/130.32 |
| 5,296,872 | A | 3/1994 | Caamano | |
| 5,846,005 | A | 12/1998 | Britz et al. | |
| 6,616,360 | B2 | 9/2003 | Lehmkuhl | |
| 6,664,995 | B2 | 12/2003 | Milton et al. | |

(Continued)

FOREIGN PATENT DOCUMENTS

| | | | |
|---|---|---|---|
| CN | 108081755 | A | 5/2018 |
| EP | 0915050 | A1 | 5/1999 |
| EP | 1974938 | A1 | 10/2008 |

OTHER PUBLICATIONS

European Search Report issued for related EP application serial No. 20176458.6, dated Nov. 26, 2020.

*Primary Examiner* — David H Banh

(74) *Attorney, Agent, or Firm* — Westman, Champlin & Koehler, P.A.; Z. Peter Sawicki; Amanda M. Prose

(57) ABSTRACT

A system and method for stabilizing a substrate during printing of images and subsequent cutting of the printing images with the system. The system comprises a printer assembly and a cutting assembly for printing images on a print media and then cutting the images from the print media. The printer assembly and cutting assembly are positioned in the system such that the media is printed and cut before advancing further through the system. The system has a web feeding system having a plurality of pairs of levers for providing different amounts of pinch force to the web during the printing and cutting processes so as to retain the media in a substantially flat and stationary position for printing as well as cutting.

19 Claims, 10 Drawing Sheets

(56) References Cited

U.S. PATENT DOCUMENTS

| | | | | |
|---|---|---|---|---|
| 6,742,858 | B2 | 6/2004 | Lehmkuhl et al. | |
| 7,422,386 | B2 | 9/2008 | Ohmori et al. | |
| 8,663,410 | B2 | 3/2014 | Cummins et al. | |
| 2002/0175461 | A1* | 11/2002 | Ogasawara | B41J 11/42 271/10.11 |
| 2003/0048321 | A1* | 3/2003 | Kan | B41J 11/42 347/16 |
| 2003/0146943 | A1 | 8/2003 | Lehmkuhl et al. | |
| 2010/0032129 | A1* | 2/2010 | Tsukaguchi | B22D 11/166 164/478 |
| 2010/0259591 | A1* | 10/2010 | Tamura | B41J 13/076 347/215 |
| 2011/0215524 | A1* | 9/2011 | Inoue | B65H 7/08 271/228 |
| 2011/0293351 | A1* | 12/2011 | Kwarta | B26D 7/12 400/621 |
| 2012/0255672 | A1* | 10/2012 | Marshall | B32B 17/10 156/216 |

* cited by examiner

SECTION A-A

SECTION A-A

LABEL PRINTER AND CUTTER ASSEMBLY

CROSS-REFERENCE TO RELATED APPLICATION

The present application claims priority to and the benefit of U.S. provisional application Ser. No. 62/870,402, filed on Jul. 3, 2019, the contents of which are hereby incorporated in their entirety.

BACKGROUND

The present disclosure relates to a system for printing labels onto a continuous web and separating those labels from the web once printed. The system comprises a printing head and a cutting head such that the web passes below each head for printing and then cutting around the perimeters of a plurality of labels from the web.

Systems incorporating a plotter cutter assembly into the printer system have been described in various patents including U.S. Pat. No. 6,616,360 directed to cutting assemblies to accommodate both end cutting and plotter cutting of a label media by a common drive; controllers for controlling the print head and cutting assemblies separately are described in U.S. Pat. No. 6,742,858; and depth control of plotter cutting has been described in U.S. Pat. No. 6,664,995.

In systems where the printing and cutting processes have been combined in the system such that the media is printed and the printed images are then cut before the web advances further for subsequent printing and cutting. Problems arise when moving the web of media through the system as different directional forces are applied to the media between printing and cutting. For example, knife cutters can drag the media to one side of the system or the other depending on the direction in which the knife is moving during cutting. These different forces can cause the media to skew off to the side of the original media path.

SUMMARY

An aspect of the present disclosure relates to a system that comprises a printer assembly and a cutting assembly for printing images on a print media and then cutting the images from the print media. The printer assembly and cutting assembly are positioned in the system such that the media is printed and cut before advancing further through the system. The system has a web feeding system having a plurality of pairs of levers for providing different amounts of pinch force to the web during the printing and cutting processes so as to retain the media in a substantially flat position for printing as well as cutting.

A housing supports the printing assembly or print head and the cutting assembly, which is a plotter cutter or knife cutting assembly. A first and second pair of media pinch levers are independently engaged with the substrate such that the first pair of pinch levers provides a first pinch force when engaged with the media during printing of images and the second pair of pinch levers provides a second pinch force, greater than the first pinch force, when engaged with the media for holding the media while cutting the printed images.

When the first pair of levers is engaged with the media, the second pair is raised such that it is not engaged with the media and when the first pair of levers is raised above the media, the second pair is moved into engagement with the media.

Each of the levers in the first and second pair of pinch levers are supported on a frame and positioned over a drive roller with the first pair of levers positioned within a space between first and second levers of the second pair of levers on a length of the frame.

The drive roller comprises a knurled surface aligned with each lever of the second pair of levers and a grit surface aligned with each lever of the first pair of levers.

In one or more of the embodiments described herein, the print media comprises an adhesive backed substate such that the assembly is configured to print and cut a plurality of labels from the print media.

Another aspect of the present disclosure relates to a method of stabilizing a substrate during printing of images and cutting the images from the substrate. The method comprises feeding the substrate through a housing supporting a printing assembly and a primary cutting assembly and passing the substrate over a drive roller and under the printing assembly. Printing further comprises positioning a first pair of pinch levers in contact with the substrate and printing at least one first image on the substrate while the substrate is held in place between each lever of the first pair of pinch levers and the drive roller. Cutting comprises moving the first pair of pinch levers out of contact with the substrate and positioning a second pair of pinch levers in contact with the substrate and cutting a perimeter around the at least one first image with the primary cutting assembly while the substrate is held in place between each lever of the second pair of pinch levers and the surface of the drive roller.

The method can be repeated for continuous rolls of substrate and for printing a plurality of images such as labels as the substrate can be advanced through the system and the first pair of pinch levers move back into contact with the substrate with moving the second pair of pinch levers out of contact with the substrate and printing at least one second image on the substrate. Further cutting then comprises moving the first pair of pinch levers out of contact with the substrate and moving the second pair of pinch levers back into contact with the substrate; and cutting a perimeter around the at least one second image with the primary cutting assembly.

The cutting assembly comprises a plotter cutter having a knife assembly and a secondary cutting assembly comprises a cross-cutter or other cutting assembly configured to cut across the web.

Positioning and moving of the first and second pairs of pinch levers is carried out with a rotatable cam configured to raise the first pair of pinch levers out of engagement with the substrate while concurrently lowering the second pair of pinch levers into engagement with the substrate and configured to concurrently lower the first pair of pinch levers into engagement with the substrate while concurrently raising the second pair of pinch levers out of engagement with the substrate.

A first pinch force is provided to the substrate with the first pair of pinch levers and a second pinch force provided to the substrate with the second pair of pinch levers and the second pinch force is greater than the first pinch force.

DETAILED DESCRIPTION

Figure 1:
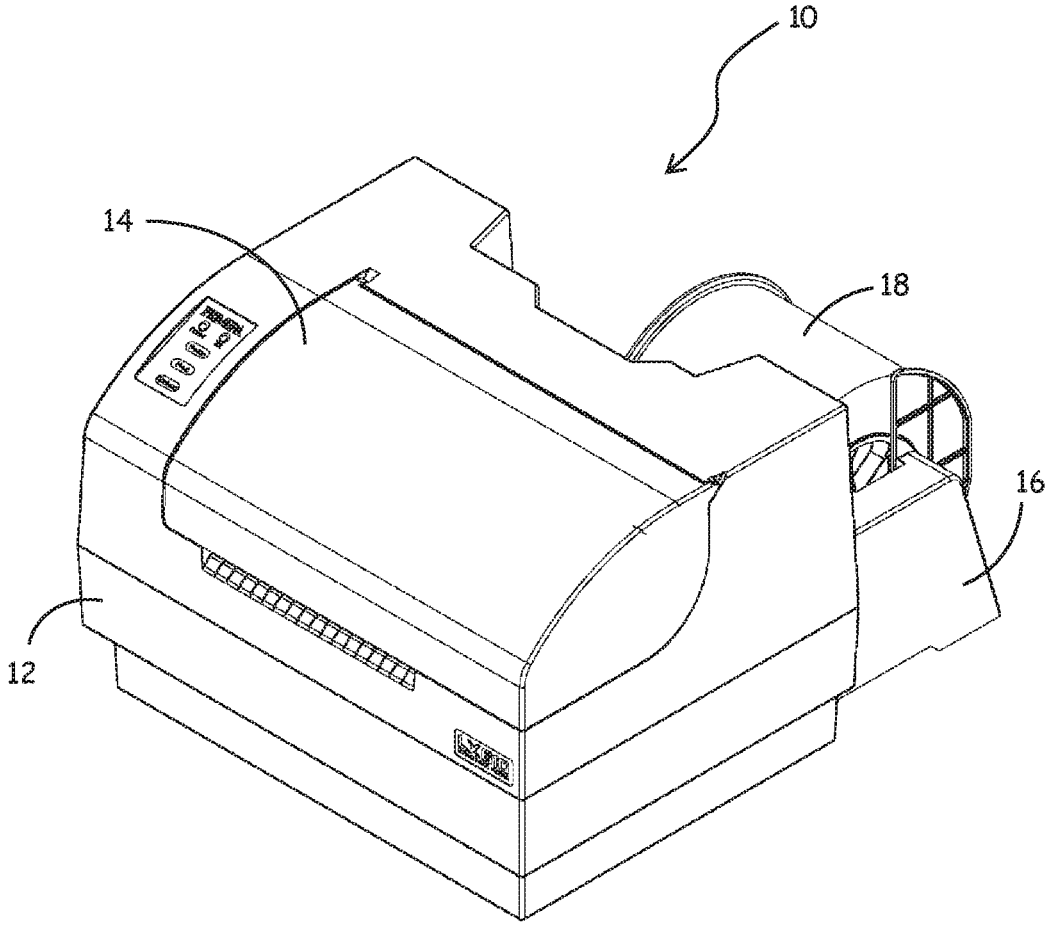
FIG. 1 is a front perspective view of the combination printing and cutting system.
Figure 2:
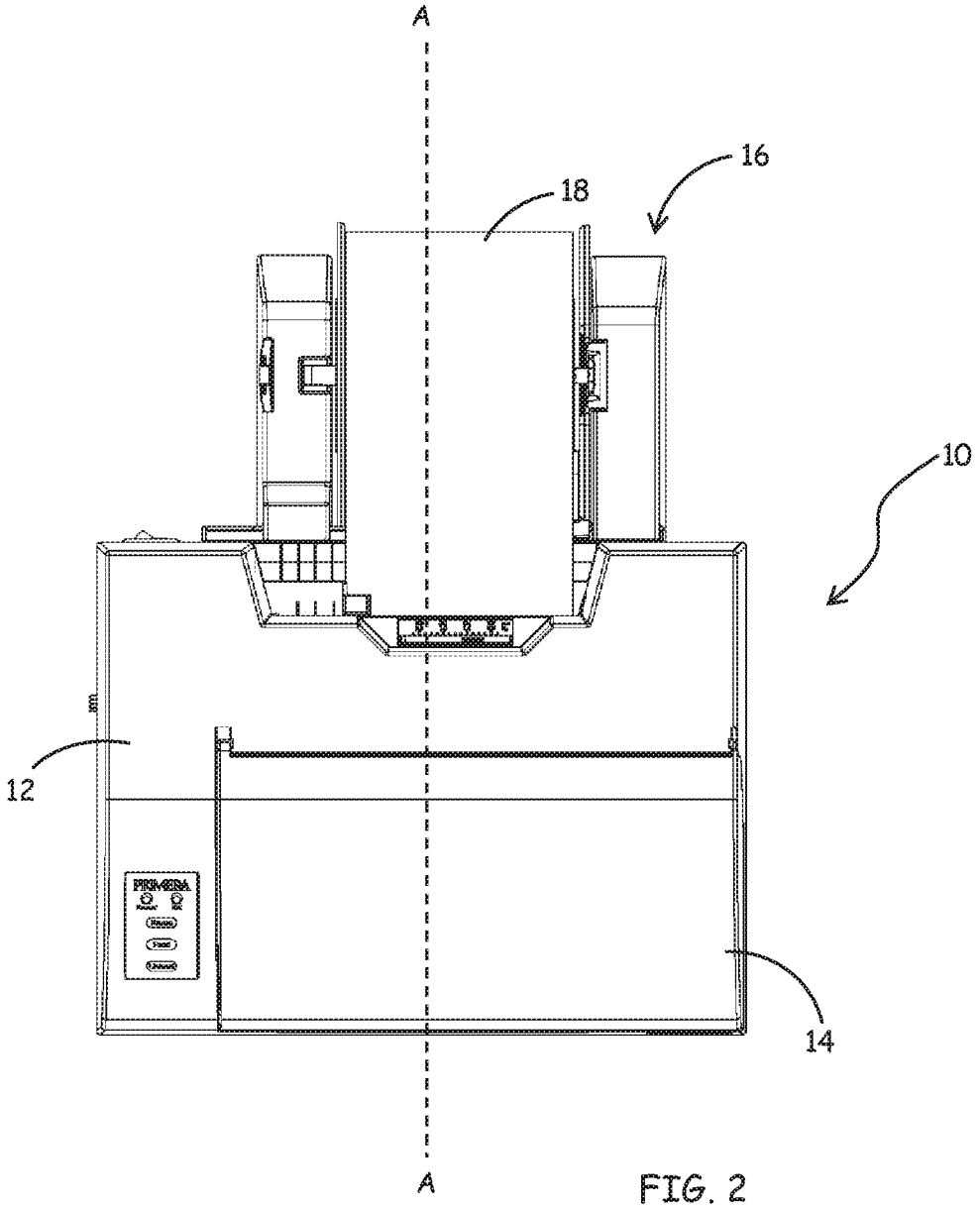
FIG. 2 is a top view of the combination printing and cutting system.
Figure 3:
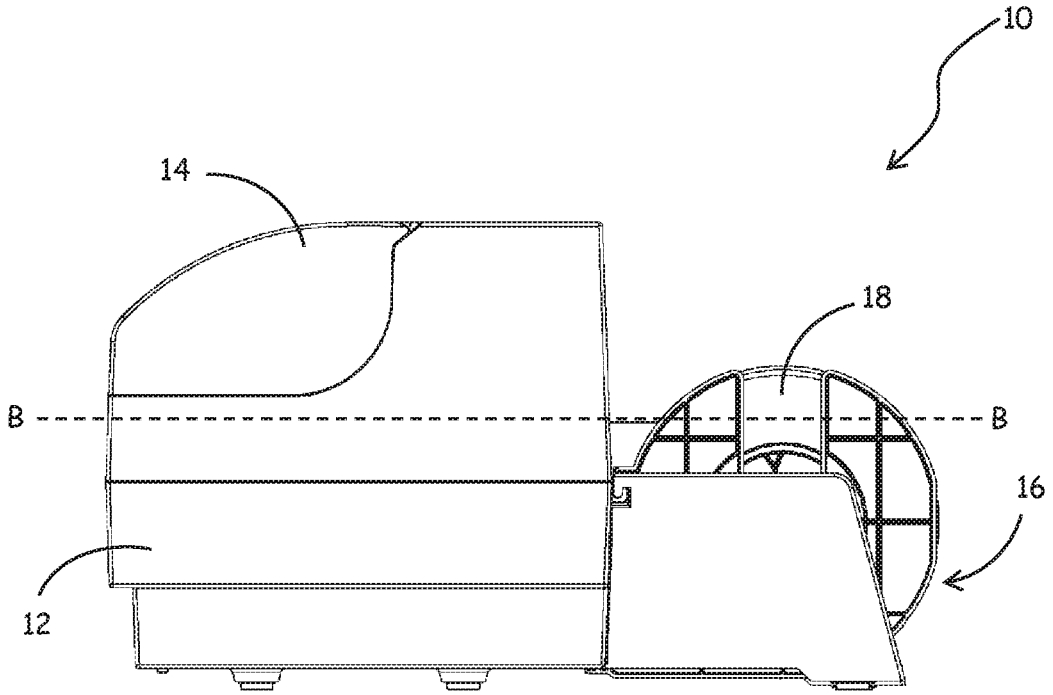
FIG. 3 is a side view of the combination printing and cutting system.
Figure 4:
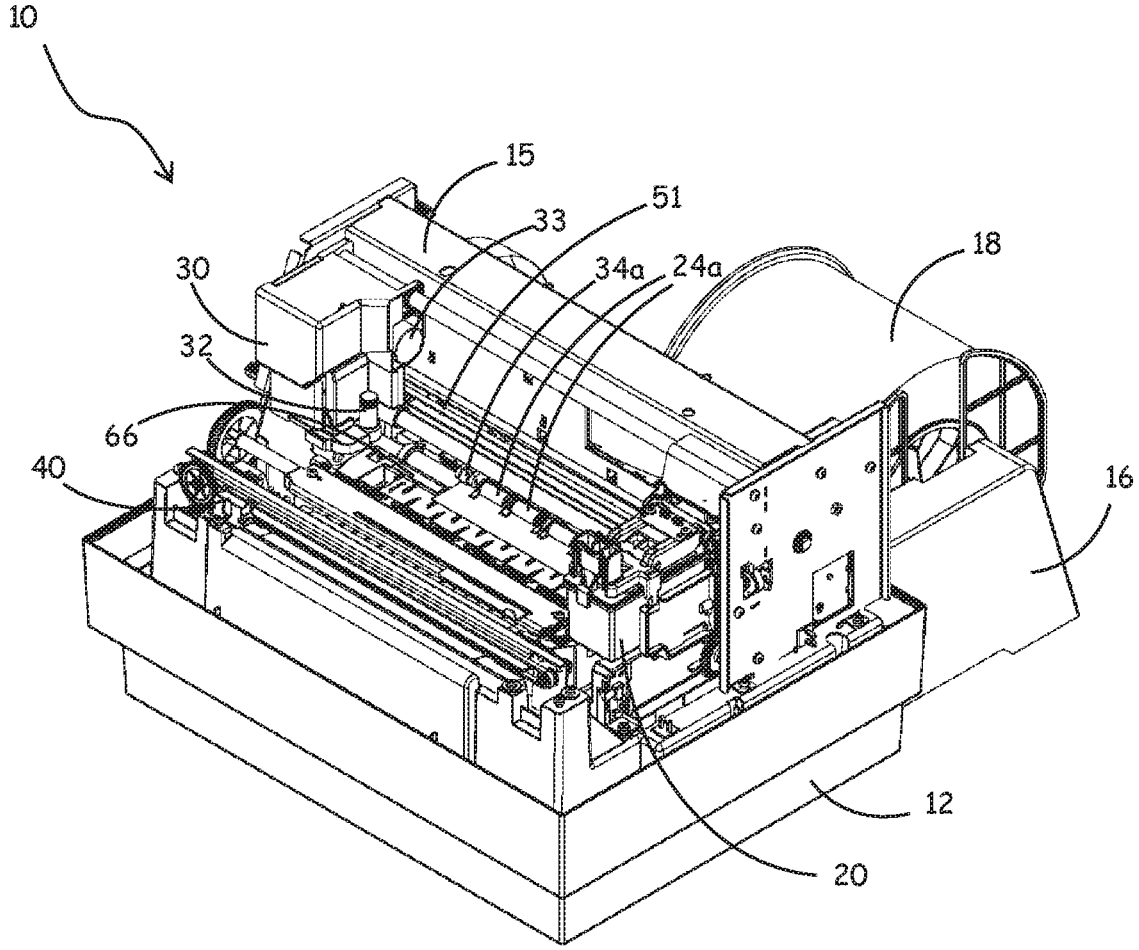
FIG. 4 is a front perspective view of the combination printing and cutting system with its cover removed, exposing the internal working components of the system.
Figure 5:
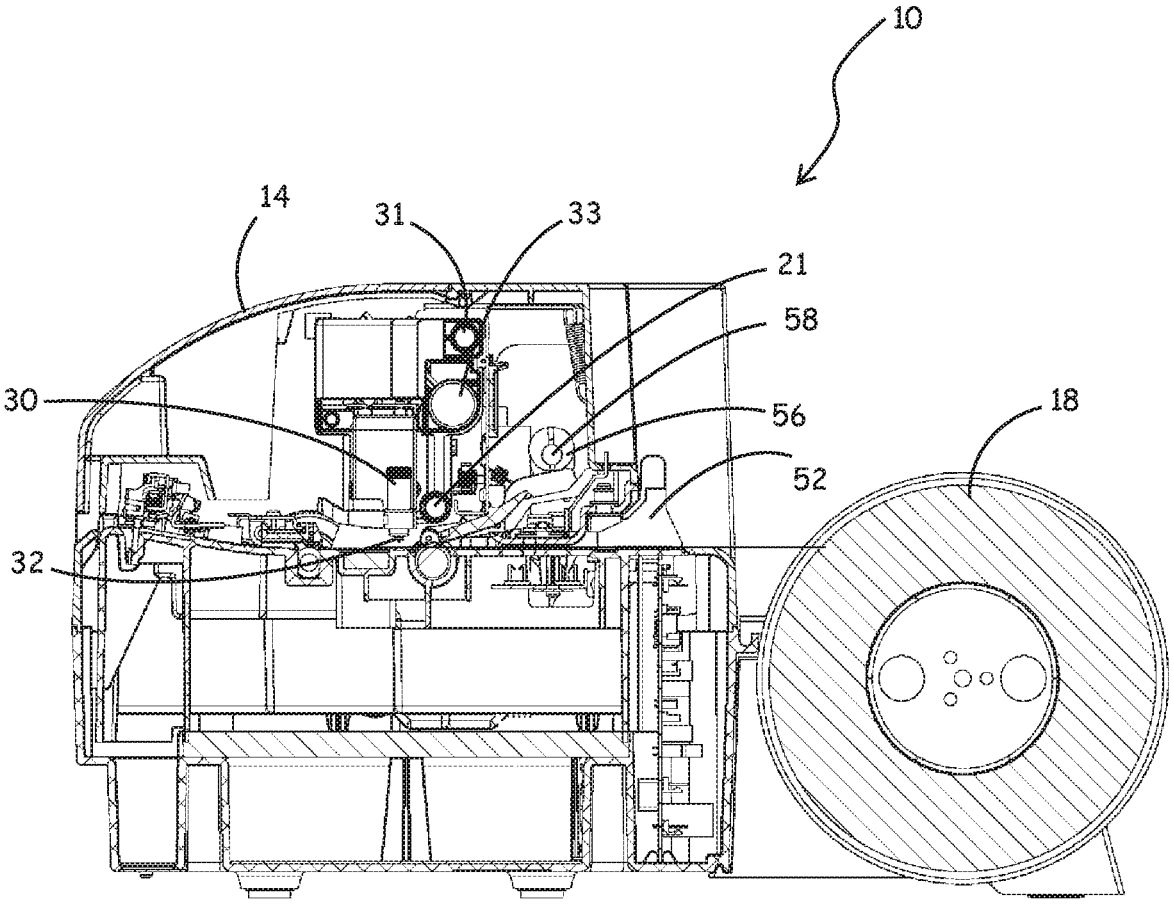
FIG. 5 is a cross sectional right side view of the combination printing and cutting system along line A-A in FIG. 2.
Figure 6:
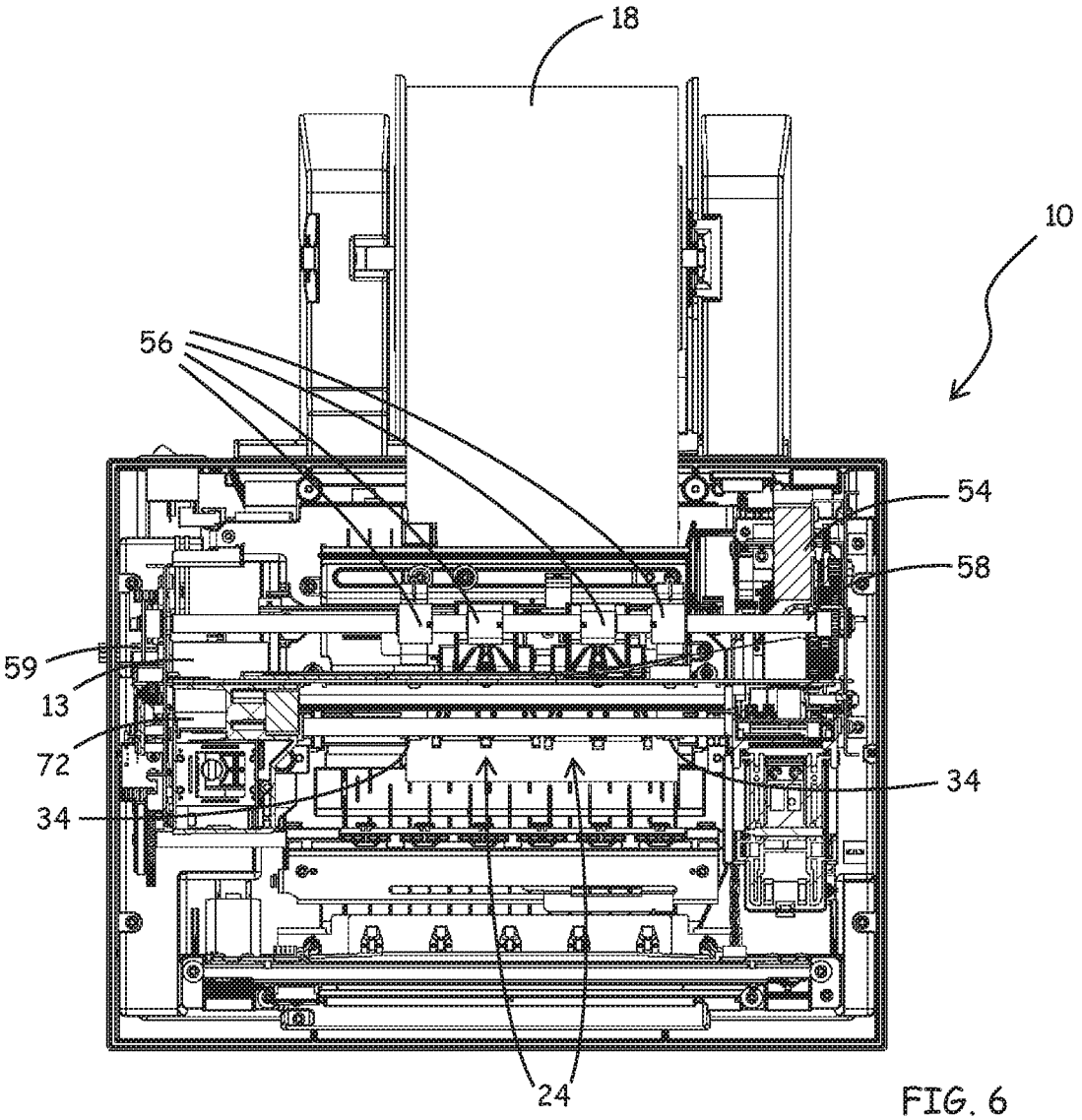
FIG. 6 is a cross sectional top view of the system with the cover removed along line B-B in FIG. 3.
Figure 7:
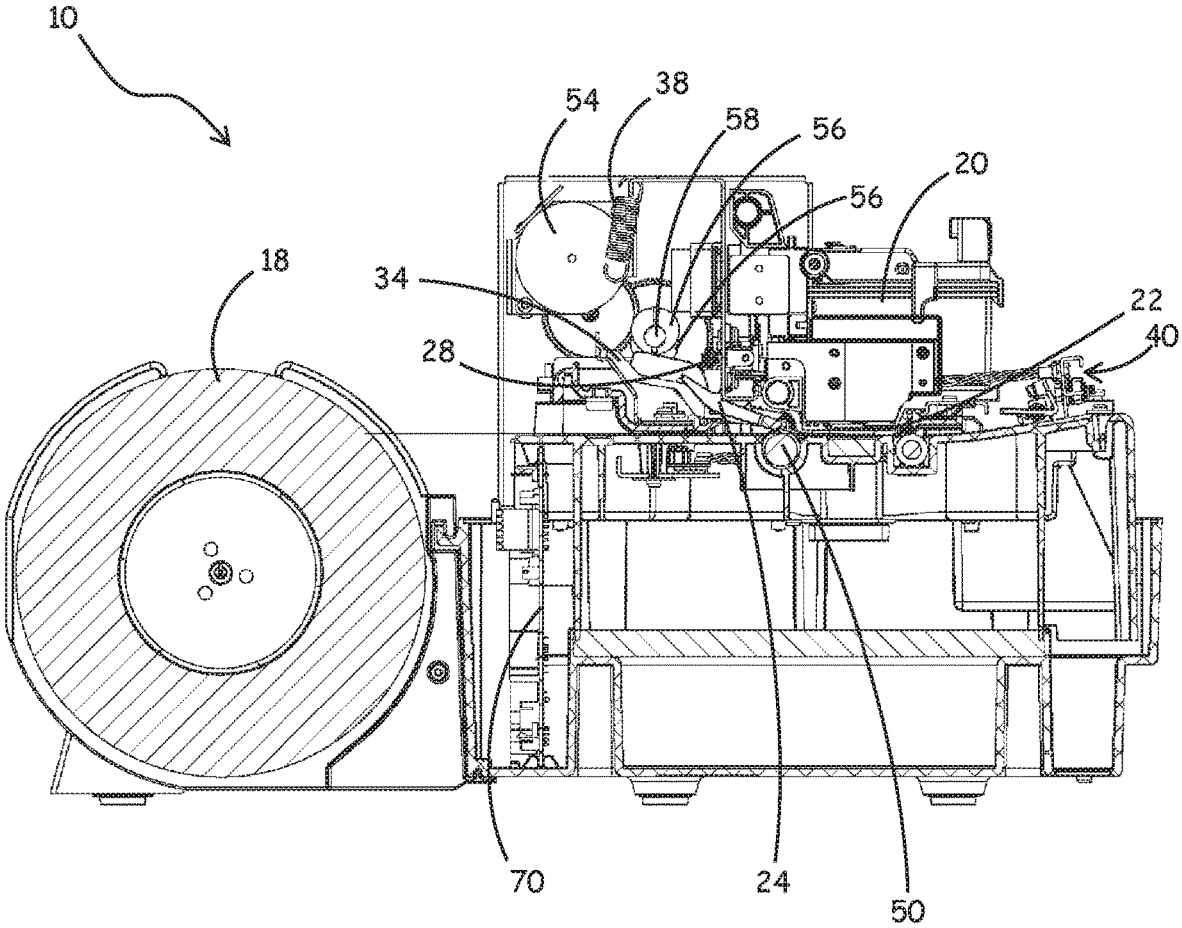
FIG. 7 is a cross sectional left side view with the cover removed.

The system described herein comprises an assembly for printing a plurality of images on a print media and subsequently cutting a perimeter around each of the printed images to remove or separate each of the printed images from a web of media. The web of media is fed into the system and one or more first images are printed on the media with a print head configured for moving in reciprocal directions across a width of the web. A cutting head is also provided and configured for moving in reciprocal directions across the width of the web for then cutting or separating the one or more first images from the media. The web may then be further advanced into and through the system for the printing and cutting of one or more second images and so forth. The system further comprises a finishing cutter for cutting across the width of the media (across the web) or otherwise forming sheets or small rolls of media, where a sheet or small roll may support one or more images and where these sheets or small rolls are easier to remove from the system. The cut images can then be physically removed from the media and the scrap media discarded or recycled.

The print head and cutting head may be supported on the same gantry for linear movement of head or supported on adjacent gantries such that the print head and cutting head are moved over substantially a same processing window where the images are printed and cut in a same or substantially same location in the system, the locations below the travel path of the print and cutting heads also referred to as a processing window, which extends across the web. The media is then advanced and/or retracted through the processing window during printing and/or cutting for purposes of printing images and cutting images having regular or irregular perimeters.

Due to the movement of the web in the system corresponding to the print and or cutting head movement during printing or cutting, the media is generally guided through the system for purposes of maintaining alignment during printing and cutting. This allows the pre-programmed cutting path to match a perimeter of the printed image, ensuring that the image is properly cut out from the media. The system described herein further advantageously incorporates two pairs of pinch levers for alternately "pinching" or holding the media in the processing window during the printing and cutting processes, respectively. The pair of pinch levers engaged with the media then holds the media down and in a printing or cutting position for preventing side to side movement or drifting and maintaining the tension of the media so the media is flat during each respective operation. The pinch levers cooperate with a drive roller below the media for moving the media through the processing window.

The process described herein may be continuous such that a supply roll of media is fed through the system, one or more first images are printed and then substantially separated from the supply roll of media by cutting, and then printing resumes for printing one or more second images which are also then substantially separated from the supply roll via cutting. What is meant by the term "substantially separated" as used with respect to the cutting perimeters around the printed images is that the printed image is "cut out" and thus separated from the media but the substantially separated image is still carried by the web of media through the printer and the substantially separated image is not fully separated from the media until the printed and cut image is lifted or pushed out from the scrap media for collection and stacking etc. Full separation of the cut printed images may occur manually or automatically and may be carried out outside of the housing or by a mechanical lifting or pushing process incorporated into the device. This process may be repeated as the material advances through the assembly until a preselected number of images are printed and cut from the supply roll.

The system described herein is a combination printer and plotter cutter 10 illustrated generally in the figures. The combination printer and plotter 10 is a system for printing images on a moving web and separating or cutting those images from the moving web. The system 10 includes a printing assembly 20 and a cutting assembly 30. The system may further include a sheet or finishing cutter 40 for cross-cutting the media 18 to provide sheets or small rolls cut from the web, whether or not these sheets contain printed and cut images.

As illustrated in FIGS. 1-7, the combination printer and cutter 10 is provided in a housing 12 having a lid 14. A supply roll of media 18 is supported on a roll web guide 16 on the housing. The housing 12 otherwise supports the operational components of the printer and cutter 10 therein. A motor 13 is provided for powering the operation of the printing assembly 20 and the cutting assembly 30. However, the printing assembly 20 and the cutting assembly 30 are independently operable for independent movement. In the embodiment illustrated the printing assembly 20 is a print head movable on a lower guide shaft 21 and on an upper guide shaft 31. The cutting assembly 30 is also movable on the lower guide shaft 21 and upper guide shaft 31. The guide shafts may be positioned near or proximate one another with one shaft above another shaft such that the print head and cutting head move across the width of the media in substantially the same area of the system.

The roll web guide 16 for the supply roll of media 18 is configured to allow the roll of media 18 to rotate for feeding the media 18 into the housing 12 for printing and/or cutting of print images. In one embodiment the system 10 is a label printer and cutter. A series of rollers including a drive roller 50 aids in controlling the movement of the media 18 into and through the housing 12 for printing and cutting. That is, the media 18 is fed through the housing 12 in a web direction and through a processing window such that the media 18 passes below the printing assembly 20 and cutting assembly 30.

The printing assembly 20 comprises one or more print nozzles 22 for depositing ink on the media 18. The cutting assembly 30 correspondingly comprises one or more cutting knives 32 for cutting the perimeters around printed images. An electromagnet 33 is also positioned on the cutting assembly 30 housing. The electromagnet 33 is used to selectively attach the printing assembly 20 to the cutting assembly 30. In the embodiment illustrated, the cutting assembly 30 is driven by a drive belt 51 attached to the motor 13. In the embodiment illustrated the cutting assembly 30 is a plotter cutter.

The system 10 further comprises a first pair of pinch levers 24 also referred to as printing pinch levers or inner pinch levers. A second pair of pinch levers 34 also referred to as cutting pinch levers or outer pinch levers. As used in connection with the pairs of pinch levers 24, 34, the terms are inner and outer are relative to one another. The inner pinch levers 24 are spaced apart from one another but are positioned inside a space separating the outside pinch levers 34. The pairs of pinch levers 24, 34 are positioned near the processing window to retain the media 18 as is it being printed or cut. Each pair of pinch levers 24, 34 selectively contacts the media 18 to pinch or guide the media during printing or cutting. Each pinch lever has at least one idler roller to create a nip point with the media drive roller 50. In the embodiment illustrated the first pair of pinch levers have two idler rollers 24*a* per lever and the second pair of pinch levers have one idler roller 34*a* per lever.

Figure 8:
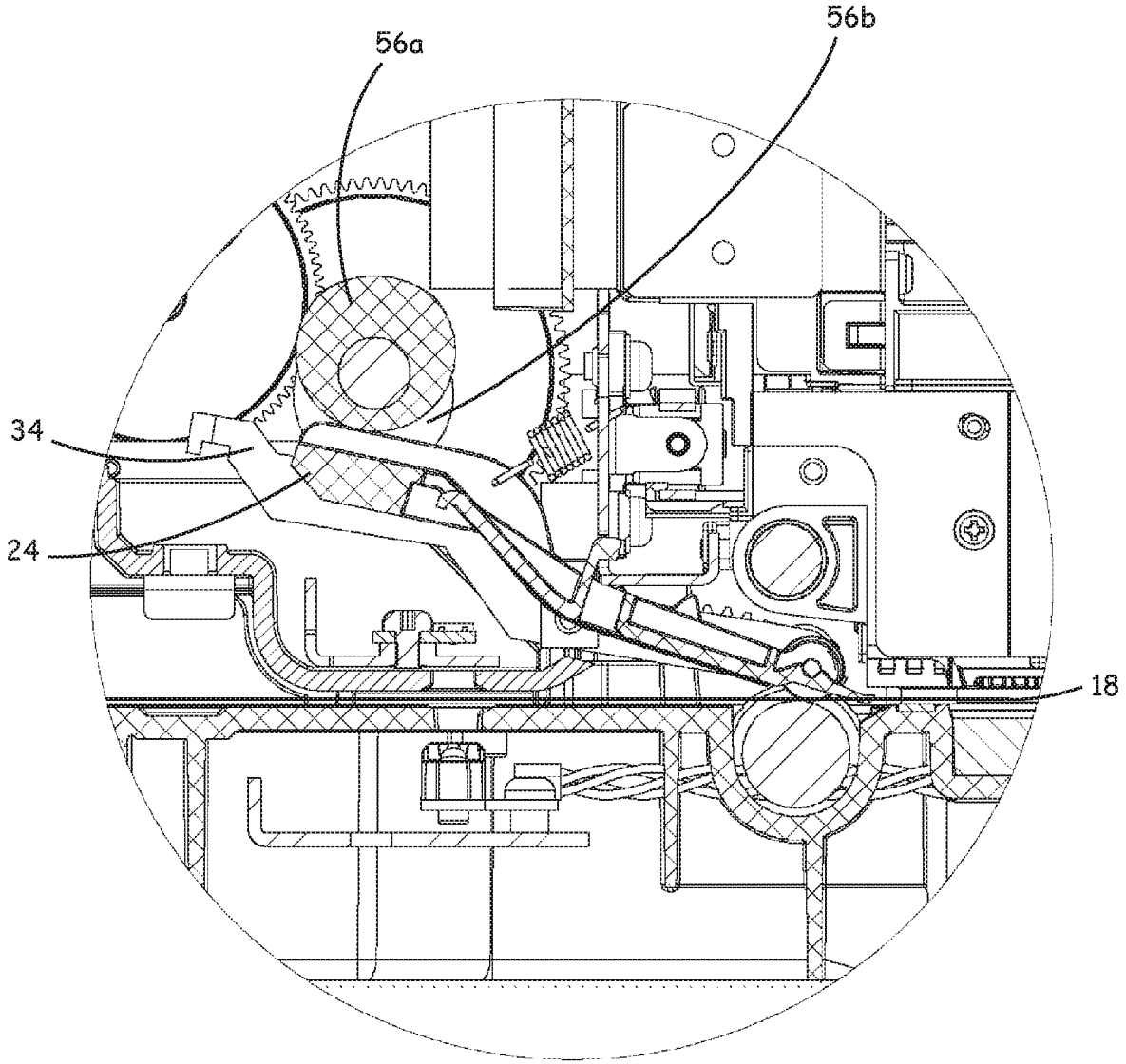
FIG. 8 is a detail cross sectional view of the pinch levers in a printing position.

Referring to FIG. 8, the inner pinch levers 24 are in a "down" position such that the inner pinch levers 24 are in contact with the media 18 when the printing assembly 20 is operating to print one or more images on the media 18. The outer pinch levers 34 are thus in an "up" position such that the outer pinch levers 34 are not in contact with the media 18. FIG. 8 illustrates a first operational position of the levers 24, 34, a printing position.

Figure 9:
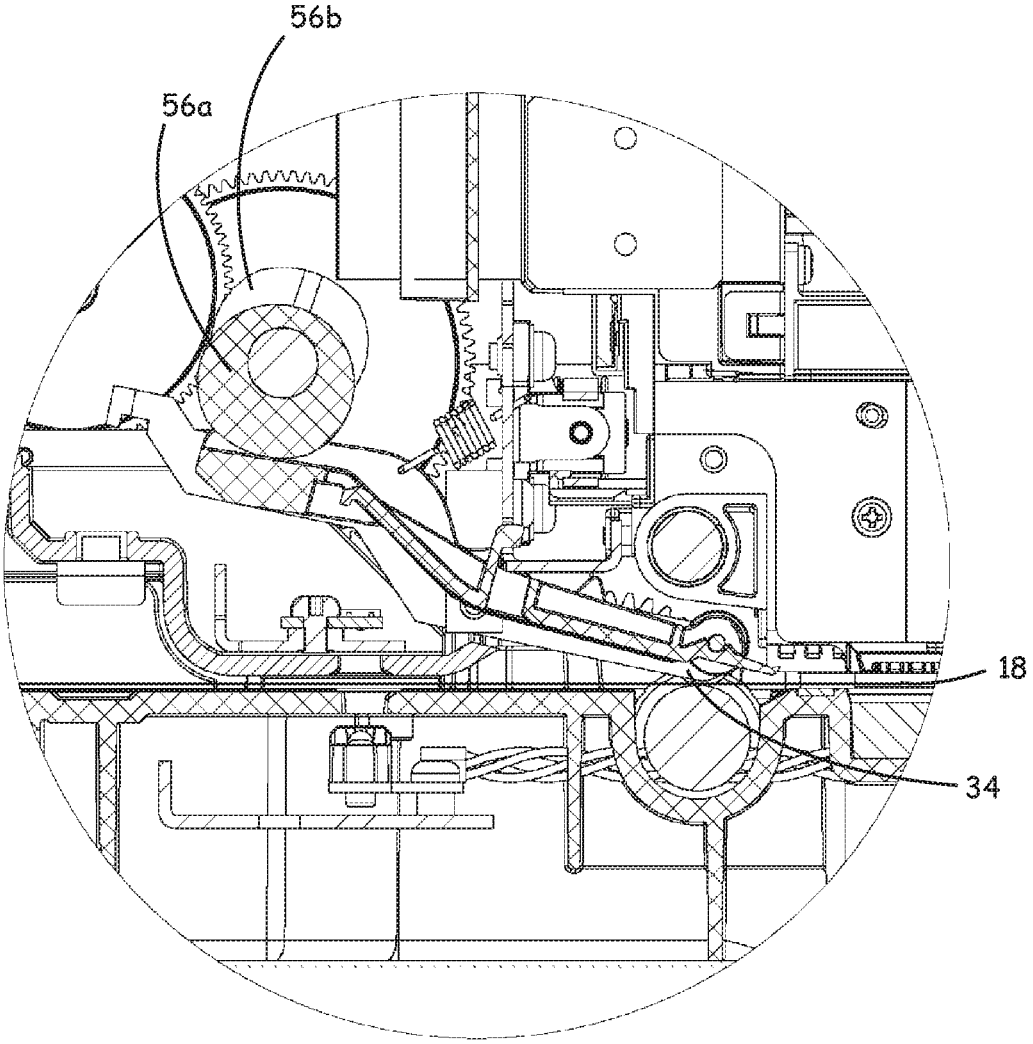
FIG. 9 is a detail cross sectional view of the pinch levers in a cutting position.
Figure 10:
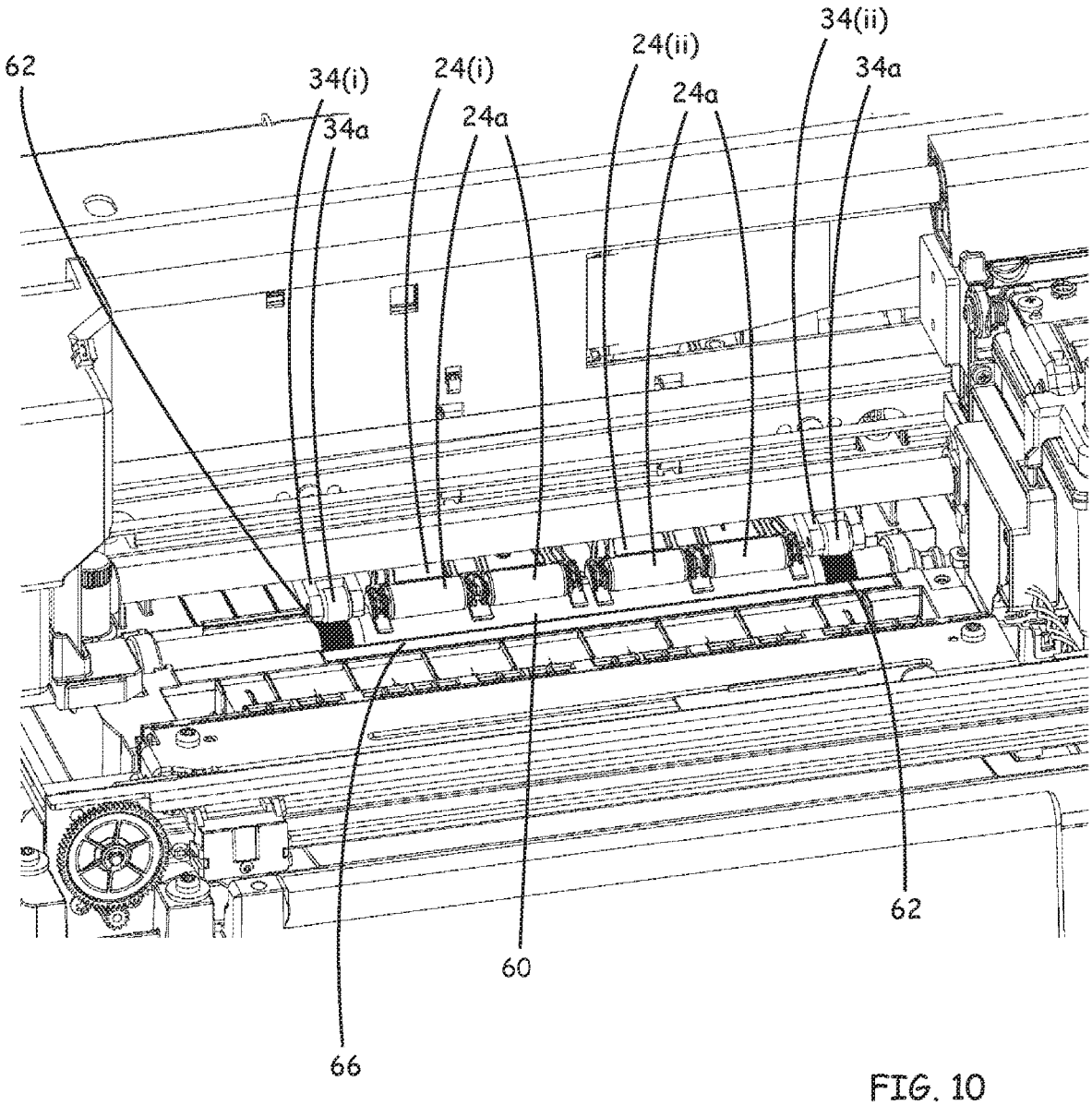
FIG. 10 is a detail view of the drive roller and pinch levers.

Referring to FIG. 9, the outer pinch levers 34 are in a "down" position such that the outer pinch levers 34 are in contact with the media 18 when the cutting assembly 30 is operating to cut one or more printed images from the media 18. The inner pinch levers 24 are thus in an "up" position such that the inner pinch levers 24 are not in contact with the media 18.

A motor 54 is operably connected to one or more pinch lever cams 56 and a shaft 58 such that the cam shaft 58 rotates to raise and/or lower the respective pair of pinch levers 24, 34. The pinch levers 24, 34 are spring operated with respective pinch lever springs 28, 38 for changing position of the respective pair of levers 24, 34. The inner pinch lever spring 28 provides a first pinch force to the inner pinch levers 24 when in the down position and contacting the media 18. The outer pinch lever spring 38 provides a second pinch force to the outer pinch levers 34. The force may be substantially the same or different between the pairs of pinch levers 24, 34. In the embodiment illustrated, the outer pinch levers 34 have a greater pinch force than the inner pinch levers 24.

Prior art label printers are set up with media pinch levers spaced across an entire media width of the device and provide enough force to allow the media to move forward without noticeable slip during the printing operation, but also allow slight slips to correct for skew in the media path if the media begins to track off course and bumps into fixed media edge guides within the printer. This skew correction mostly occurs during media feed operations so as not to affect print quality.

The media pinch levers 24, 34 and cams 56 are used to lift selected levers 24 or 34 during certain operations such as printing or plotting. The cams comprise inner cams 56*a* and outer cams 56*b* where the inner pinch levers 24 have cams 56*a* that are not engaged with the interior levers 24 when the levers 24 are in the down position and in contact with the media. The outside cams 56*b* then engage the outer levers 34 to lift up the pinch levers 34 off of the media as shown in FIG. 8. In FIG. 9, the interior cams 56*a* lift the inner levers 24 up so the levers are not touching the media while the outside cams 56*b* are not engaged with the outer levers 34 to allow the levers 34 to move down and pinch the media 18.

The pinch levers 24 and 34 are multi-force levers such that the inner pinch levers 24 have a different pinch force than the outer pinch levers 34. The two inside levers 24 are in a down position during printing to pinch the media 18 and once printing is complete, a cam shaft 58 rotates 180° causing the two inside levers 24 to lift up and concurrently allow the pair of outer pinch levers 34 to move to the down position. The two outside levers 34 have a much higher pinch force than the inside levers 24 as the increased pinch force is beneficial for cutting the images from the media and holding the media in place during cutting.

A sensor 59 may be provided for rotation of the cam shaft 58 for switching operational positions of the levers 24, 34.

The cam shaft 58 extends across the width of the housing 12 across the width of the media 18 and processing window. A frame 15 supports each of the levers 24(*i*), 24(*ii*) and 34(*i*), 34(*ii*) thereon and are raised or lowered using the cam shaft 58. The levers 24, 34 are positioned with respect to the processing window to hold the media 18 when printing or cutting respectively. The arrangement of the levers 24, 34 in the system 10 addresses issues with media feeding and tracking media through the printer when using the cutting assembly 30. Prior art systems require wider media, s-wraps around feed rollers, have active media tracking controls, or have separate drive systems for printing and cutting to keep the media moving through the system and tracking nicely in a substantially flat and sufficiently taut state. However, system 10 disclosed herein allows for a reduction in cost and size of the apparatus, while eliminating the need for wider media, s-wraps, active media tracking controls, and separate drive systems for printing and cutting by way of the pinch levers described herein.

When plotter cutting the label shapes out of the continuous media 18, extra drag from the knife blade will make the media tend to skew to one side or the other, depending upon where the knife is cutting and the direction it is moving. To overcome this skew, more force is provided to the outside pinch levers. If the extra force is used on the inside levers, or the printing pinch levers, during the printing process the media will be unable to slip and self-correct when bumping into the fixed media guides and will instead continue to drive into the fixed edge guides until it rolls over on itself enough to cause a media jam. To address these opposing needs, the device 10 allows for lighter (standard) force printer pinch levers to be used when printing and heavier force pinch levers to be used on the outside when cutting. This allows the media to correct its path when in the print mode, and the levers to grip the media tightly enough to not slip while in the plotting mode. The overall length of the plotting cut along the length of the media web will be limited by how accurately the media is aligned during the print mode. In this device 10, the plot length can be up to about 30" with good operation, which satisfies the needs of the vast majority of the label market.

For printing and cutting, the media 18 is fed from the roll web guide 16 into the housing 12 and may pass through an adjustable media guide 52 as the media enters into the processing window. The media 18 is also moved through the device by way of the drive roller 50 where the media passes over the drive roller 50.

The drive roller 50, in connection with a paper feed motor 72, controls the advancing of the media through the printer. The media may move through the device in reciprocal directions (e.g., forward and backward along the web direction) to assist in printing and cutting of perimeters around the printed image(s) as the printing assembly 20 and the plotter cutter assembly 30 move in reciprocal directions across the media 18 width.

The sheet cutter 40 is provided for separating sheets from or otherwise trimming the printed and cut media 18 exiting the housing 12. This is an optional cutter that may also be used to separate scrap material or otherwise cut the media 18 from the supply roll into sheets having shorter lengths so as to enable easier stacking, removal or other uses of the media. The sheets cut by the sheet cutter 40 may have one or more separated or cut target image therein which can be manually removed from the cut sheet or media and the scrap media reused, recycled, or discarded.

A main control board 70 is provided for electrical connections to enable printing and cutting operations and the control board may be a printed circuit board 70.

A print roller surface in ink jet media printers is typically a grit roller. This surface works adequately under the media print levers and plotting levers, but in order to achieve even greater levels of accurate tracking during the plotting (cutting) process, embodiments of the system 10 may further comprise a finely knurled segment which may be added to the print roller 50 in the areas aligned underneath the plotting levers. The area between the knurled segments thus remains a grit surface. The knurled segments provide a greater co-efficient of friction than the grit surface to allow for increased gripping by the outer levers during cutting.

For example, the knurled segments 62 are positioned on opposing ends of the print roller 50 and are each aligned to one of the outer pinch levers 34 while the inner pinch levers 24 are positioned on the grit portion 60 of the print roller 50. A plotter knife holder may also be positioned adjacent the print roller 50 and a plotter cutter wear strip 66 may be positioned forward of the print roller 50.

Although the present disclosure has been described with reference to preferred embodiments, workers skilled in the art will recognize that changes may be made in form and detail without departing from the spirit and scope of the disclosure.

The invention claimed is:

1. An assembly for printing and cutting print media comprising:

a housing;

a printing assembly;

a cutting assembly;

a first and second pair of media pinch levers are operable to alternately engage with the print media and wherein the first pair of pinch levers provides a first pinch force when engaged with the print media for holding the print media during printing processes and the second pair of pinch levers provides a second pinch force greater than the first pinch force when engaged with the print media for holding the print media during a cutting process; and a controller for enabling printing operations, cutting operations, and for moving the first and second pairs of media pinch levers to alternately engage with the print media.

2. The assembly of claim 1 wherein the first pair of pinch levers engages with the print media during the printing process and the second pair of pinch levers does not engage with the print media during the printing process.

3. The assembly of claim 1 wherein the second pair of pinch levers engages with the print media during the cutting process and the first pair of pinch levers does not engage with the print media during the cutting process.

4. The assembly of claim 1 wherein each of the levers in the first and second pair of pinch levers are positioned over a drive roller with the first pair of levers positioned within a space between first and second levers of the second pair of levers.

5. The assembly of claim 1 wherein each of the levers in the first and second pair of pinch levers are operated by a cam shaft and positioned over a drive roller with the first pair of levers positioned within a space between first and second levers of the second pair of levers on a length of the cam shaft.

6. The assembly of claim 1 and further comprising a drive roller comprising a knurled surface aligned with each lever of the second pair of levers and a grit surface aligned with each lever of the first pair of levers.

7. The assembly of claim 1 wherein the print media is provided as a continuous web of print media fed through the housing for printing and cutting and wherein the assembly further comprises a sheet cutter for separating sheets or a small roll from the web of print media.

8. The assembly of claim 1 and further comprising a pinch lever spring for operation of each of the first pair and second pair of pinch levers and for providing a force to the levers for engaging the print media between the drive roller and pinch levers.

9. The assembly of claim 1 wherein the print media comprises an adhesive backed substrate for printing and cutting a plurality of labels.

10. A method of stabilizing a substrate during printing of images thereon and during cutting the printed images from the substrate comprising:

feeding the substrate through a housing supporting a printing assembly and a cutting assembly and passing the substrate over a drive roller and under the printing assembly;

positioning a first pair of pinch levers in contact with the substrate;

printing at least one first image on the substrate while the substrate is held in place between each lever of the first pair of pinch levers and the drive roller;

moving the first pair of pinch levers out of contact with the substrate and positioning a second pair of pinch levers in contact with the substrate;

cutting a perimeter around at least one first image with the cutting assembly while the substrate is held in place between each lever of the second pair of pinch levers and the drive roller.

11. The method of claim 10 and further comprising:

advancing the substrate through the housing;

moving the first pair of pinch levers back into contact with the substrate and moving the second pair of pinch levers out of contact with the substrate;

printing at least one second image on the substrate;

moving the first pair of pinch levers out of contact with the substrate and moving the second pair of pinch levers back into contact with the substrate; and cutting a perimeter around the at least one second image with the cutting assembly.

12. The method of claim 10 wherein the cutting assembly is a primary cutting assembly and further comprising providing a continuous supply of substrate from a supply roll and advancing the substrate through the printing and primary cutting assembly to a secondary cutting assembly and separating a sheet or small roll of substrate from the continuous supply roll.

13. The method of claim 12 where in the primary cutting assembly is a plotter cutter having a knife assembly and the secondary cutting assembly is a cross-cut cutter.

14. The method of claim 10 wherein positioning and moving of the first and second pairs of pinch levers is carried out with a rotatable cam configured to raise the first pair of pinch levers out of engagement with the substrate while concurrently lowering the second pair of pinch levers into engagement with the substrate and configured to concurrently lower the first pair of pinch levers into engagement with the substrate while concurrently raising the second pair of pinch levers out of engagement with the substrate.

15. The method of claim 10 and providing a first pinch force to the substrate with the first pair of pinch levers and then providing a second pinch force to the substrate with the second pair of pinch levers wherein the second pinch force is greater than the first pinch force.

16. The method of claim 10 wherein the first and second pinch force is controlled by a first spring and a second spring for providing pinch force to the first and second pairs of pinch levers respectively.

17. The method of claim 10 wherein each of the levers in the first and second pair of pinch levers are positioned over a drive roller with the first pair of levers positioned within a space between first and second levers of the second pair of levers.

18. The method of claim 10 wherein each of the levers in the first and second pair of pinch levers are operated by a cam shaft and positioned over a drive roller with the first pair of levers positioned within a space between first and second levers of the second pair of levers on a length of the cam shaft.

19. The method of claim 10 wherein the drive roller comprises a knurled surface aligned with each lever of the second pair of levers and a grit surface aligned with each lever of the first pair of levers.

* * * * *